US007500289B2

(12) United States Patent
Többen

(10) Patent No.: US 7,500,289 B2
(45) Date of Patent: Mar. 10, 2009

(54) ADJUSTABLE MACHINE ELEMENT ASSEMBLY FOR A SPINNING PREPARATION MACHINE

(75) Inventor: Robert Többen, Mönchengladbach (DE)

(73) Assignee: Truetzschler GmbH & Co. KG, Moechengladbach (DE)

( * ) Notice: Subject to any disclaimer, the term of this patent is extended or adjusted under 35 U.S.C. 154(b) by 473 days.

(21) Appl. No.: 11/338,685

(22) Filed: Jan. 25, 2006

(65) Prior Publication Data

US 2006/0168763 A1 Aug. 3, 2006

(30) Foreign Application Priority Data

Feb. 3, 2005 (DE) ..... 10 2005 005 200

(51) Int. Cl.
*D01G 15/12* (2006.01)

(52) U.S. Cl. ..... 19/98

(58) Field of Classification Search ..... 19/98, 19/99, 102–104, 113
See application file for complete search history.

(56) References Cited

U.S. PATENT DOCUMENTS

| | | | | |
|---|---|---|---|---|
| 3,448,684 | A | 6/1969 | Cardinet et al. | |
| 3,881,281 | A | 5/1975 | Hollingsworth | |
| 4,984,395 | A | 1/1991 | Demuth et al. | |
| 5,277,000 | A | 1/1994 | Demuth et al. | |
| 5,797,788 | A | 8/1998 | Graf et al. | |
| 5,853,318 | A | 12/1998 | Thom et al. | |
| 5,894,636 | A | 4/1999 | Sauter et al. | |
| 6,085,390 | A * | 7/2000 | Leifeld | 19/113 |
| 6,106,381 | A | 8/2000 | Leder et al. | |
| 6,431,969 | B1 | 8/2002 | Sauter et al. | |
| 6,863,591 | B2 | 3/2005 | Graf et al. | |
| 6,973,699 | B2 * | 12/2005 | Leder | 19/98 |
| 7,055,222 | B2 * | 6/2006 | Bischofberger et al. | 19/114 |
| 7,131,896 | B2 | 11/2006 | Faas et al. | |

(Continued)

FOREIGN PATENT DOCUMENTS

CH 681 230 A5 2/1993

(Continued)

OTHER PUBLICATIONS

Preliminary Search Report and Written Opinion dated Oct. 29, 2007, issued in FR 06 50368.

(Continued)

*Primary Examiner*—Shaun R Hurley
(74) *Attorney, Agent, or Firm*—Venable LLP; Robert Kinberg; Justine A. Gozzi

(57) ABSTRACT

In an apparatus on a spinning preparation machine, at least one machine element lies opposite and spaced apart from the clothing of a roller, and bearing surfaces of the end portions of the machine element are in engagement with respective bearing surfaces of stationary bearings. An adjustment means is arranged in the region of each of the end portions for altering the radial spacing between the clothing of the roller and the machine element. To enable the carding nip to be adapted or kept constant in the event of thermally induced changes in dimensions, the machine element and the bearings each have inclined bearing surfaces, and the machine element, in the event of undergoing thermally induced expansion in its longitudinal direction, is so displaceable along the sloping surfaces that the radial spacing remains the same.

26 Claims, 6 Drawing Sheets

U.S. PATENT DOCUMENTS

| | | | | |
|---|---|---|---|---|
| 2002/0152585 | A1 * | 10/2002 | Wust et al. | 19/103 |
| 2007/0128984 | A1 | 6/2007 | Leder et al. | |

FOREIGN PATENT DOCUMENTS

| | | | |
|---|---|---|---|
| CH | 681 546 | A5 | 4/1993 |
| DE | 36 01 906 | A1 | 8/1987 |
| DE | 93 13 633.1 | U1 | 2/1994 |
| DE | 196 05 635 | A1 | 8/1997 |
| DE | 198 09 330 | A1 | 9/1999 |
| DE | 198 31 139 | A1 | 1/2000 |
| DE | 101 06 315 | A1 | 8/2002 |
| DE | 103 18 968 | A1 | 11/2004 |
| EP | 0233370 | A1 | 8/1987 |
| EP | 0 422 838 | A2 | 4/1991 |
| EP | 0 497 736 | A1 | 8/1992 |
| EP | 0532454 | A1 | 3/1993 |
| EP | 1 231 303 | A1 | 8/2002 |
| EP | 1 430 997 | A1 | 6/2004 |
| FR | 1 502 646 | | 11/1967 |
| FR | 2 452 372 | | 10/1980 |
| GB | 111216 | A | 11/1917 |
| GB | 775123 | A | 5/1957 |
| GB | 2045144 | A | 10/1980 |
| GB | 2334972 | A | 9/1999 |
| GB | 2340509 | A | 2/2000 |
| GB | 2 340 509 | B | 9/2002 |
| GB | 2386131 | A | 9/2003 |
| GB | 2 421 250 | A | 6/2006 |

OTHER PUBLICATIONS

European Search Report dated May 9, 2006, issued in GB 0602024.2.
German Search Report for DE 10 2005 055 916.6, dated Mar. 15, 2006.
German Search Report for DE 10 2005 005 222.3, dated Feb. 3, 2005.
French Search Report for FR 06050373, dated Oct. 26, 2007.

* cited by examiner

ADJUSTABLE MACHINE ELEMENT ASSEMBLY FOR A SPINNING PREPARATION MACHINE

CROSS REFERENCE TO RELATED APPLICATION

This application claims priority from German Patent Application No. 10 2005 005 200.2 dated 3 Feb. 2005, the entire disclosure of which is incorporated herein by reference.

BACKGROUND OF THE INVENTION

The invention relates to an apparatus on a spinning preparation machine, especially a flat card, roller card or the like, in which at least one clothed and/or non-clothed, basically stationary machine element lies opposite and spaced apart from the clothing of a roller, for example a cylinder.

In certain known arrangements the bearing surfaces of the end portions of the machine element are in engagement with respective bearing surfaces of stationary bearings and there are arranged in the region of each of the end portions and the bearings an adjustment means which is able to alter the radial spacing between the clothing of the roller and the machine element.

The spacings between the cylinder clothing and surfaces lying opposite the cylinder clothing (counter-surfaces) are of major importance for the technical characteristics of the machinery and fibres. The carding result, that is to say in terms of cleaning, nep formation and fibre shortening, is substantially dependent upon the carding nip, that is to say the spacing between the cylinder clothing and the clothings of the revolving and fixed card tops. Guiding air around the cylinder and directing away heat are likewise dependent upon the spacing between the cylinder clothing and clothed or non-clothed surfaces lying opposite, for example take-off blades or casing elements. The spacings are subject to a variety of influences, some of which act counter to one another. The wear to clothings lying opposite one another results in an increase in the size of the carding nip, which is associated with a rise in the number of neps and with a reduction in fibre shortening. Increasing the speed of rotation of the cylinder, for example in order to enhance the cleaning action, entails expansion of the cylinder, including the clothing, as a result of centrifugal force and, consequently, brings about a reduction in the size of the carding nip. Also, during the processing of large amounts of fibre and certain kinds of fibre, for example synthetic fibres, as a result of a rise in temperature the cylinder expands to a greater extent than does the rest of the surrounding machinery, so that the spacings become smaller for that reason also. The machine elements lying radially opposite the cylinder, for example fixed carding segments and/or take-off blades, also expand.

The carding nip is affected especially by the machine settings on the one hand and by the condition of the clothing on the other hand. The most important carding nip of the revolving card top carding machine is located in the main carding zone, that is to say between the cylinder and the revolving card top assembly. At least one clothing which limits the working spacing of the carding zone as a whole is in motion. In order to increase the production rate of the carding machine, it is sought to select an operating rotational speed, i.e. the operating speed of the moving parts, that is as high as fibre processing technology allows. The working spacing is effected in the radial direction (starting from the rotational axis) of the cylinder.

During carding, increasingly large amounts of fibre material are processed per unit of time, which requires higher working component speeds and higher outputs. The increasing throughput of fibre material (production rate), even when the working surface area remains constant, results in increased generation of heat as a result of the mechanical work. At the same time, however, the technological carding result (sliver uniformity, degree of cleaning, nep reduction etc.) is constantly being improved, which requires a greater number of effective surfaces in carding engagement and narrower settings of those effective surfaces with respect to the cylinder (tambour). The proportion of synthetic fibres being processed, which—compared with cotton—generate more heat as a result of friction when in contact with the effective surfaces of the machine, is continually increasing. The working components of high performance carding machines are nowadays totally enclosed on all sides in order to conform to the high safety standards, to prevent the emission of particles into the spinning room environment and to minimise the need for servicing of the machines. Grids or even open, material-guiding surfaces allowing exchange of air are a thing of the past. The said circumstances markedly increase the input of heat into the machine, while the discharge of heat by means of convection is markedly reduced. The resulting more intense heating of high performance carding machines leads to greater thermoelastic deformation which, on account of the non-uniform distribution of the temperature field, affects the set spacings of the effective surfaces: the gaps between cylinder and card top, doffer, fixed card tops and take-off stations having blades are reduced. In an extreme case, the set gap between the effective surfaces can be completely consumed by thermal expansion, so that components moving relative to one another collide, resulting in considerable damage to the affected high performance carding machine. Accordingly, particularly the generation of heat in the working region of the carding machine can lead to different degrees of thermal expansion when the temperature differences between the components are too great.

In a known apparatus (EP 0 422 838) the cylinder of a carding machine is associated with a plurality of stationary carding segments (fixed carding segments) each of which is attached by way of its end portions to the associated side frame of the carding machine. On each end face of each carding segment there is a plate having a lug towards the outside, on which a fixing screw having an adjustment nut is mounted. By manual operation of the adjustment nut, the radial spacing of the clothing of the carding segment with respect to the cylinder clothing can be adjusted individually. The adjustment operation by way of the adjustment nuts for the purpose of obtaining a desired and uniform carding nip at the beginning of assembly or in the event of readjustment is complicated. Adjustment can be made only with the machine at a standstill with the result that, in addition, the ongoing production operation of the carding machine is interrupted.

It is an aim of the invention to provide an apparatus of the kind described at the beginning which avoids or mitigates the mentioned disadvantages, which is especially simple in terms of structure and assembly and which enables the carding nip to be adapted or kept constant in the event of thermally induced changes in the dimensions of the machine element and/or the roller, especially during ongoing operation.

SUMMARY OF THE INVENTION

The invention provides an adjustable machine element assembly for a spinning preparation machine, comprising:

a machine element arranged, in use, to lie opposed to and spaced from a roller of the spinning preparation machine and having a working portion and opposed first and second end portions, there being provided a first machine element bearing surface on said first end portion and a second machine element bearing surface on said second end portion;

first and second machine bearing surfaces associated with the spinning preparation machine;

wherein said first machine element bearing surface and said first machine bearing surface co-operate to form a first adjusting structure and said second machine element bearing surface and said second machine bearing surface co-operate to form a second adjusting structure, said machine element bearing surfaces and said machine bearing surfaces each being inclined and the direction of inclination of the inclined surfaces being substantially the same in each of said first and second adjusting structures, whereby on thermally induced expansion of the machine element in a longitudinal direction relative displacement along the inclined surfaces can take place in such a manner that the spacing of the machine element from the roller can be maintained substantially unchanged.

As a result of the features according to the invention it is possible, in response to changes in technological variables, especially the generation of heat during the carding operation, to maintain a constant carding nip. A further particular advantage is that when the machine element has been displaced, the spacing between the carding segment clothings and the cylinder clothing, which spacing is uniform at all points around the circumference, is retained, thus achieving a considerable improvement in the sliver produced. An important concept comprises converting the thermally induced longitudinal expansion of a supporting body for a fixed carding element, which supporting body is arranged axially parallel to the cylinder, into a change in the spacing of the supporting body radially with respect to the cylinder. For that purpose, the end regions of the supporting body and the bearing surfaces on the carding machine each have a sloping surface along which the end regions are able to slide. To implement active adjustment, for example by means of an adjusting drive means, the angles of the sloping surfaces are arranged in the same direction as one another, so that the end regions are displaced in the same direction. Particularly advantageous is the precise setting or adaptation of the narrow carding nip, for example 3/1000", to a desired value in response to thermally induced changes in dimensions. The displacement is possible during ongoing operation.

The machine element may have at least one carding surface, and may be, for example, a fixed carding element. The machine element may instead be a take-off blade or a cover element. The machine element may be a supporting body made of, for example, aluminium, preferably extruded aluminium, and is especially an extruded hollow aluminium profile.

Advantageously, there are two co-operating wedge-shaped elements in the region of each of the end portions and the bearings. Advantageously, the longitudinal expansion of the aluminium support profile, for example, Twin-Top cassette, is mechanically convertible into a change in the spacing with respect to the cylinder. Advantageously, the elements for changing the spacing are arranged on the bearing points of the working element. Advantageously, the bearing points are in the form of an inclined plane, so that in the event of a change in length of the working element its height relative to the cylinder is adjustable. The size of the angle of the inclined plane is advantageously such that the expansion of the cylinder is compensated. For example, the angle may be about from 35° to 55°, especially from 35° to 45°. Advantageously, for fixing the spacing of the left-hand and right-hand bearing points there is an element in the form of a connecting bridge from left to right which has a low thermal expansion coefficient. The element may consist of a composite material, for example CFP, and/or Invarstahl. Advantageously, for centering the cassette or the machine element between the bearing points there are used resilient elements at the ends. Advantageously, the centering of the cassette or the machine element is effected by a central fixing with the connecting bridge. Advantageously, for active adjustment of the spacing between the cylinder and the carding element, the inclined planes are formed in the same direction on the right and on the left in order to change the spacing of the working element with respect to the cylinder by means of an adjusting drive means. Advantageously, the adjusting drive means is an adjusting screw. Advantageously, the adjusting drive means is an adjusting motor. Advantageously, for active displacement, existing signals, such as temperatures and/or pressures, are used as detectors. The adjusting elements (bearing members) may be a separate component of the bearings, or they may be attached to the bearings, or be an integral part of the bearings. The bearings themselves may have sloping surfaces. The machine bearings may be, for example, curved extension pieces of a carding machine, or the side panels of a carding machine. The adjusting elements (bearing members) of the machine element may be a separate component of the machine element, which may be attached to the machine element. Instead, they may be an integral part of the machine element. As well or instead, the end portions of the machine elements may have sloping surfaces.

The invention further provides an apparatus on a spinning preparation machine, especially a flat card, roller card or the like, in which at least one clothed and/or non-clothed, basically stationary machine element lies opposite and spaced apart from the clothing of a roller, for example a cylinder, the bearing surfaces of the end portions of the machine element being in engagement with respective bearing surfaces of stationary bearings and there being arranged in the region of each of the end portions and the bearings an adjustment means which is able to alter the radial spacing between the clothing of the roller and the machine element, wherein adjusting elements of the machine element and adjusting elements of the bearings each have sloping surfaces, the angles of the sloping surfaces on both sides are formed in the same direction as one another, and the machine element, in the event of undergoing thermally induced expansion in its longitudinal direction, is so displaceable along the sloping surfaces by means of the adjustment means that the radial spacing remains the same.

Moreover the invention provides a method of maintaining a spacing between a roller of a spinning preparation machine and a working element, comprising causing bearing surfaces of the working element to be displaced, relative to bearing surfaces of the machine, along a pair of bearing planes that are inclined relative to the axial direction of the roller, the bearing planes each being angled in the same direction.

DETAILED DESCRIPTION OF CERTAIN PREFERRED EMBODIMENTS

Figure 1:
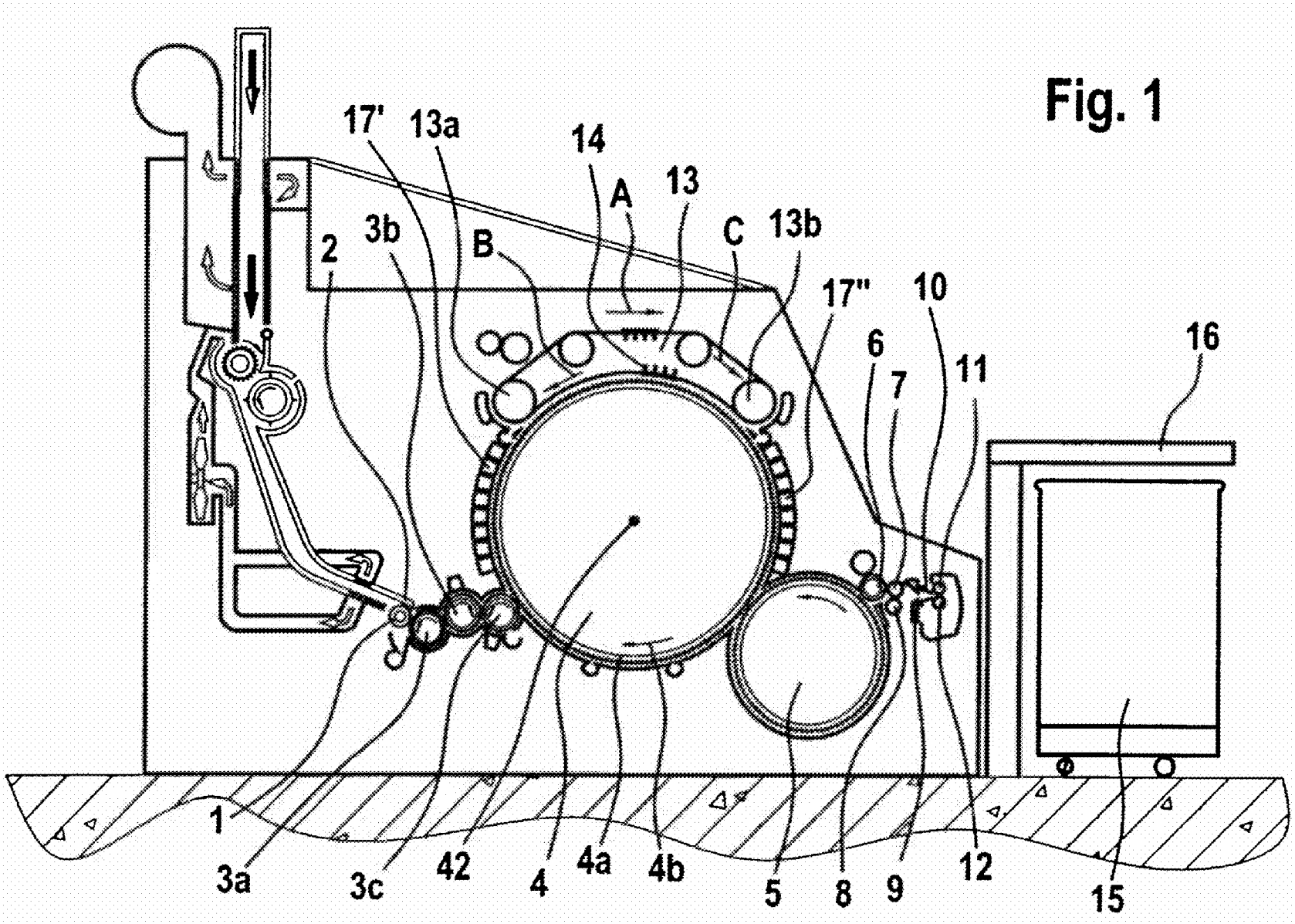
FIG. 1 is a diagrammatic side view of a carding machine having the apparatus according to the invention.

With reference to FIG. 1, a carding machine, for example a flat card TC 03 (trade mark), made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, sliver funnel 10, delivery rollers 11, 12, revolving card top 13 with card top guide rollers 13*a*, 13*b* and flat bars 14, can 15 and coiler 16. The directions of rotation of the rollers are indicated by curved arrows. Reference numeral 42 denotes the centre point (axis) of the cylinder 4. Reference numeral 4*a* denotes the clothing and reference numeral 4*b* the direction of rotation of the cylinder 4. Reference letter B denotes the direction of rotation of the revolving card top 13 in the carding position and reference letter C denotes the return transport direction of the flat bars 14. Stationary machine elements or working elements, for example fixed carding elements 17', are arranged between the licker-in 3*c* and the rear card top guide roller 13*a*, and stationary machine elements or working elements, for example fixed carding elements 17", are arranged between the forward card top guide roller 13*b* and the doffer 5. The arrow A indicates the working direction. The arrows drawn inside the rollers indicate the direction of rotation of the rollers.

Figure 2:
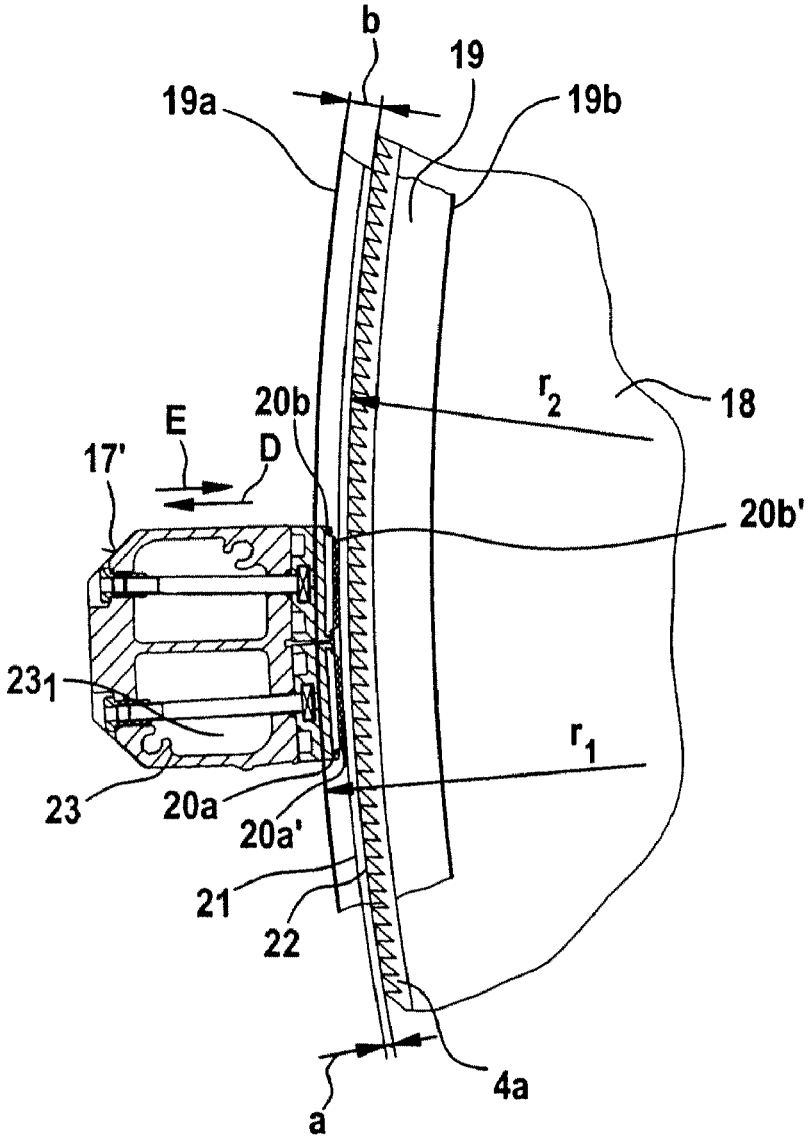
FIG. 2 shows a carding segment, a portion of a side panel with spacing between the card segment clothing and cylinder clothing.
Figure 2A:
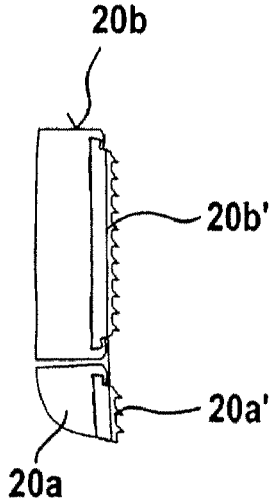
FIG. 2*a* shows the carding elements according to FIG. 2 in detail.

Referring to FIG. 2, on each side of the carding machine there is mounted, laterally on the machine frame (not shown), an approximately semi-circular rigid side panel 18 which has, integrally formed concentrically on its outer side in the region of the periphery, a curved rigid bearing element 19 having as support surface a convex outer surface 19*a* and an underside 19*b*.

Carding elements 17' have at their two ends bearing surfaces which rest on the convex outer surface 19*a* of the bearing element. Carding elements 20*a*, 20*b* having carding clothings 20*a'*, 20*b'* are mounted on the lower surface of the carding segment 17'. Reference numeral 21 denotes the circle of tips of the clothings. The cylinder 4 has a cylinder clothing 4*a*, for example sawtooth clothing, around its circumference. Reference numeral 22 denotes the circle of tips of the cylinder clothing 4*a*. The spacing between the circle of tips 21 and the circle of tips 22 is indicated by reference letter a and is, for example, 0.20 mm. The spacing between the convex outer surface 19*a* and the circle of tips 22 is indicated by reference letter b. The radius of the convex outer surface 19*a* is indicated by reference letter $r_1$ and the radius of the circle of tips 22 is indicated by reference letter $r_2$. The radii $r_1$ and $r_2$ intersect at the centre point 42 (see FIG. 1) of the cylinder 4.

The carding segment 17' according to FIG. 2 consists of a support 23 and two carding elements 20*a*, 20*b* which are arranged one after the other in the direction of rotation (arrow 4*b*) of the cylinder 4, the clothings of the carding elements 20*a*, 20*b* and the clothing 4*a* of the cylinder 4 lying opposite one another. The wedge-shaped adjusting device (see FIG. 4*a*, 4*b*) effects the displacement of the support 23 in the direction axially parallel to the cylinder axis 42, so that on displacement the carding segment 17' is moved in the direction of arrows D, E. The spacing a between the clothings 20*a'*, 20*b'* of the carding elements 20*a*, 20*b* and the cylinder clothing 4*a* can thus be set in a simple and exact way.

The supporting body 23 consists of a hollow aluminium profile and has continuous cavities 23'. The cylinder 4 consists, for example, of steel and has a hollow-cylindrical wall and two end discs.

Figure 3A:
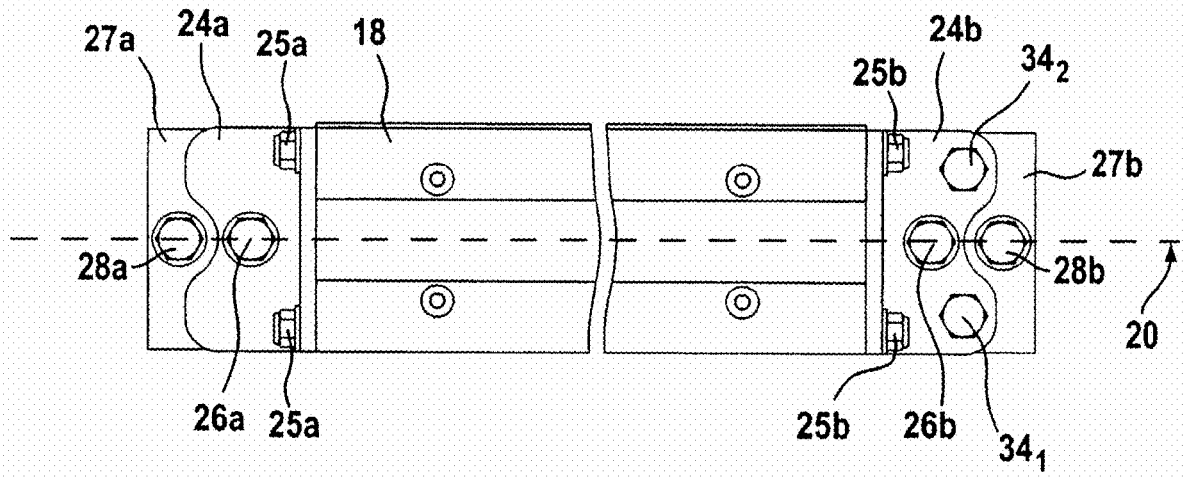
FIG. 3*a* is a plan view of the fixing arrangement at the two ends of the carding segment.
Figure 3B:
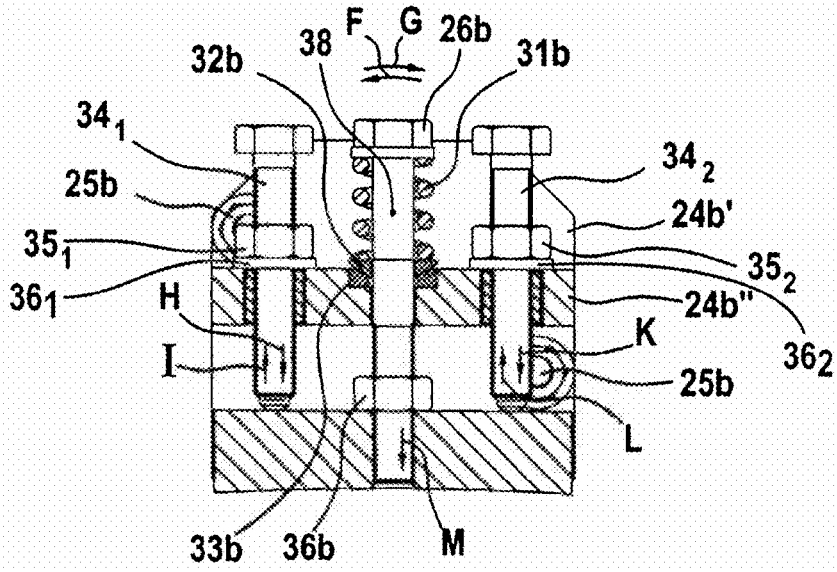
FIG. 3*b* is a side view of the fixing arrangement at one end according to FIG. 3*a;*
Figure 3C:
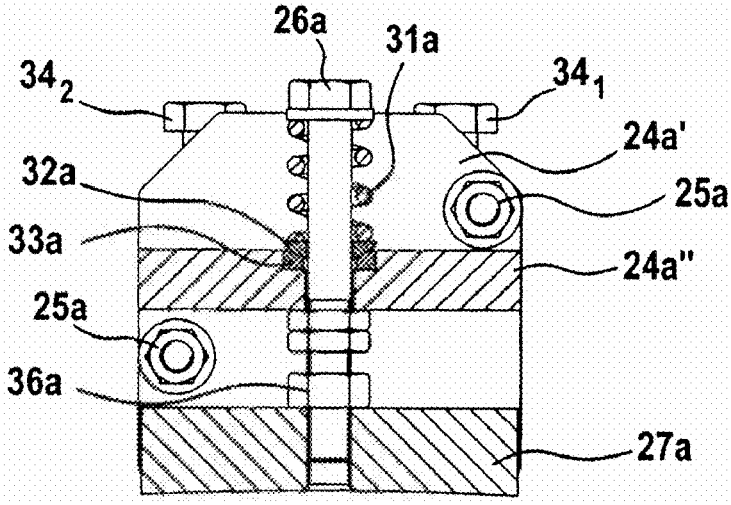
FIG. 3*c* is a side view of the fixing arrangement at the other end region of the carding segment according to FIG. 3*a;*

In accordance with FIGS. 3*a*, 3*b* and 3*c*, on each of the two ends of the support 23 there is mounted an end element 24*a*, 24*b* which consists essentially of two plates 24*a'*, 24*a"* and 24*b'*, 24*b"* arranged at right-angles to one another. The plates 24*a'*, 24*b*, are screwed to the support 23 by means of screws 25*a*, 25*b*, respectively. The plates 24*a"*, 24*b"* are each penetrated by a screw 26*a*, 26*b* which in turn engages in a thread in a mounting plate 27*a*, 27*b*, respectively. The mounting plates 27*a*, 27*b* are attached by means of screws 28*a*, 28*b* to a curved extension piece 19*a*, 19*b*, respectively. The screws 26*a*, 26*b* each pass through a compression spring 31*a*, 31*b*, respectively, each of which is supported by its one end on the heads of the screws 26*a*, 26*b* and by its other end on the flat surface of a domed cap 32*a*, 32*b* mounted on the screw 26*a*, 26*b*, respectively.

The convex surface of the domed cap 32*a*, 32*b* engages the concave surface of a bearing disc 33*a*, 33*b*, the domed cap and the bearing disc in each case forming a pivot bearing. The bearing disc 33*a*, 33*b* is mounted on the upper side of the plate 24*a"*, 33*b"*, respectively.

As FIG. 3*b* shows, there are also two adjustment screws $\mathbf{34}_1$, $\mathbf{34}_2$, which pass through bores having bearing bushes in the plate 24*b"* and are supported by their convex end face on the upper side of the mounting plate 27*b*. The adjustment screws 34.sub.1, 34.sub.2 are each associated, above the mounting plate 27*b*, with a locking nut 35.sub.1, 35.sub.2 having a washer 36.sub.1, 36.sub.2, respectively. When the adjustment screw 34.sub.1 is moved in the direction of arrow I by rotation about its longitudinal axis, by way of the plate 24*b"* all the components that are rigidly connected to the plate 24*b"* are rotated about the rotational axis 20 in the direction of the curved arrow G. When the adjustment screw 34.sub.1 is moved in the direction of arrow H, the plate 24*b"* is rotated in the direction of arrow F. In corresponding manner, the plate 24*b"* is moved in the direction of arrow F or G when the adjustment screw 34.sub.2 is moved in the direction of arrow K or L, respectively. The adjustment screws 34.sub.1, 34.sub.2 can be moved individually, while the respective other adjustment screw is not moved. It is also possible, however, for both adjustment screws 34.sub.1 and 34.sub.2 to be moved in opposite directions. By movement of the adjustment screws 34.sub.1 and 34.sub.2 in the ways described above, rotation about the rotational axis 38 is effected in such a manner that the support 23 and the carding elements 20*a*, 20*b* mounted on the support 23 are rotated in the same direction. As a result, the spacing a or b between the clothings 20*a'*, 20*b'* and the cylinder clothing 4*b* is set as desired. If required, the spacings set may be the same, but it may also be advantageous, for example, when a widening or narrowing carding nip is desired.

As shown in FIGS. 3*b* and 3*c*, below the plates 24*a*", 24*b*" the screws 26*a*, 26*b* are associated with locking nuts 36*a*, 36*b*, which are supported on the upper side of the mounting plate 27*a*, 27*b*, respectively. When the screw 26*b* is moved in the direction of arrow M by rotation about its longitudinal axis 20, the plate 24*b*" is pressed downwards by the force of the spring 31*b* by way of the pivot bearing 32*b*, 33*b*, so that at that end region of the carding segment 17 the spacing of the clothings 20*a*', 20*b*, with respect to the cylinder clothing 4*b* is altered. In this way, the spacing of the carding segment 17 across the width of the machine, that is to say the spacing between the clothings 20*a*', 20*b*' on the one hand and the cylinder clothing 4*b* on the other hand across the width of the machine, can be set to a desired value, especially to the same value at both ends of the carding segment 17. At such a setting, the pivot bearing 32*a*, 33*a* at the other end also becomes operative.

The use of the apparatus according to FIGS. 3*a* to 3*c* advantageously simplifies and shortens the setting procedure on assembly. A particular advantage is that at the same time the spacings of the clothings 20*a*', 20*b*', on the one hand, with respect to the cylinder clothing 4*b* and, on the other hand, both in the direction of rotation 4*a* of the cylinder 4 and across the width of the cylinder 4, are set exactly, and permitting fine adjustment by means of the adjustment screws.

Figure 4A:
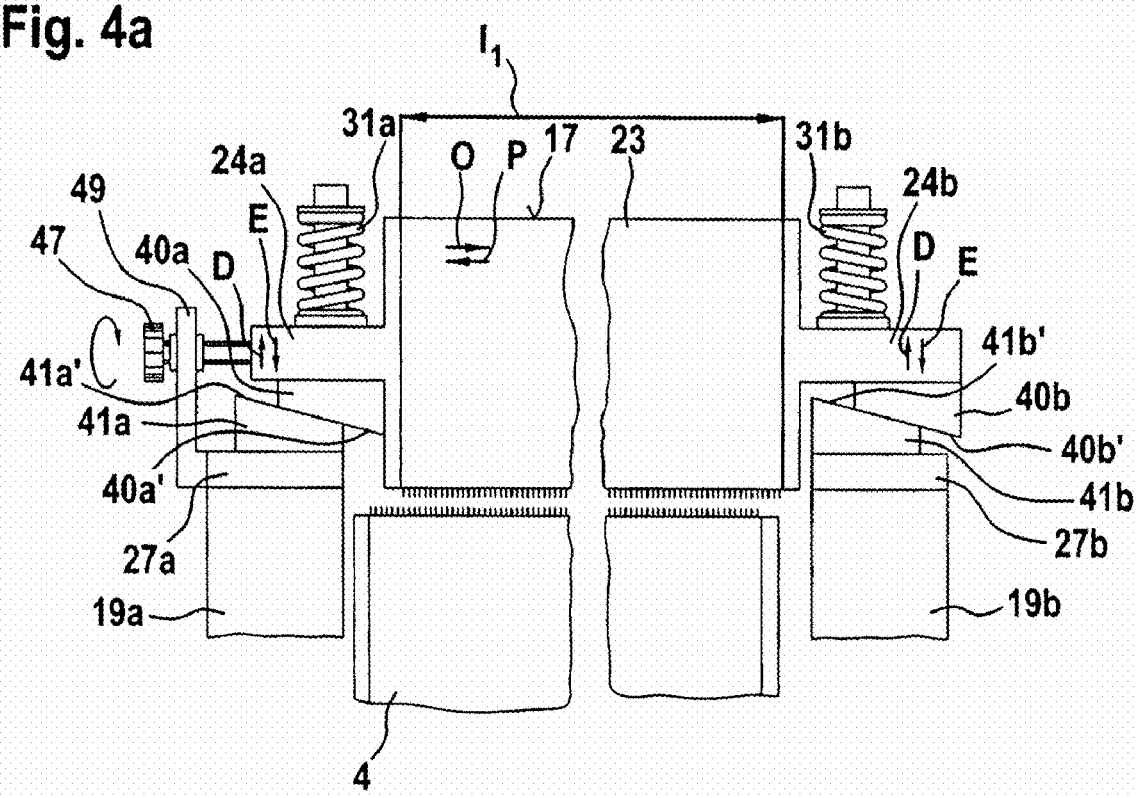
FIG. 4*a*, 4*b* is a front view of the carding segment according to FIGS. 3*a* to 3*c* having the apparatus according to the invention, in which co-operating sloping surfaces are present on both sides in the region of the end portions and the bearings, the carding element being displaced, on heating, from the position according to FIG. 4*a* into the position according to FIG. 4*b;*
Figure 4B:
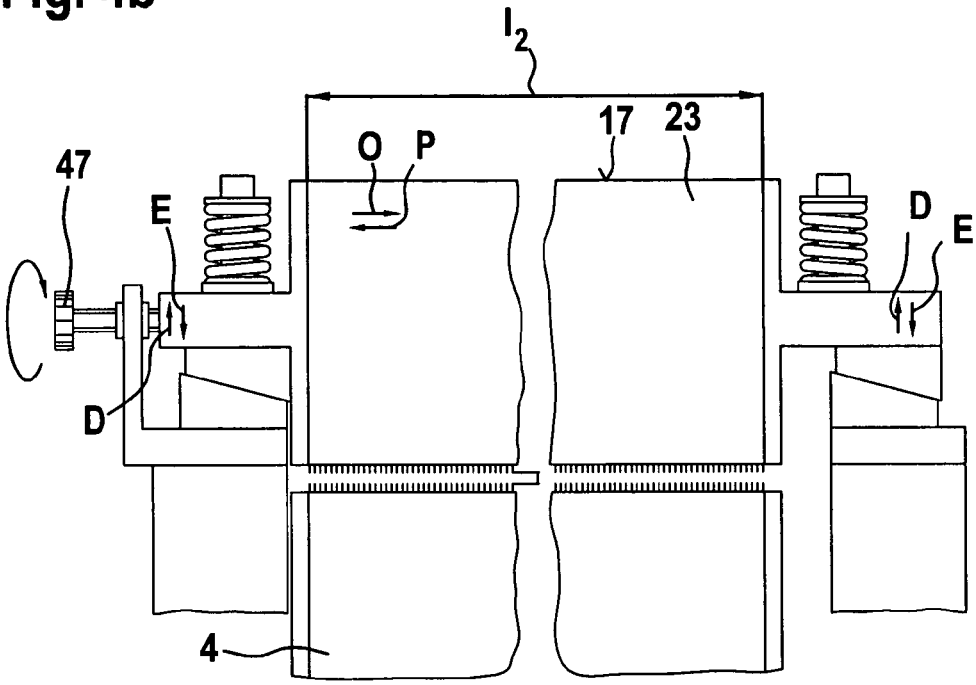

With reference to FIGS. 4*a*, 4*b*, between the plate 24*a* and the mounting plate 27*a* as well as between the plate 24*b* and the mounting plate 27*b* there are arranged as adjustment means two wedge-shaped adjusting elements 40*a*, 41*a* and 40*b*, 41*b*, respectively, the sloping surfaces of which co-operate. On their surfaces remote from the sloping surfaces, the adjusting elements 40*a* and 40*b* are attached to the plates 24*a*, 24*b*, respectively, and the adjusting elements 41*a*, 41*b* are attached to the mounting plates 27*a*, 27*b*, respectively, by means of fixing elements, for example screws, by adhesive bonding or the like. The sloping surfaces of the adjusting elements 40*a*, 40*b*, 41*a*, 41*b* are aligned in the direction of the axis 42 of the cylinder 4 and are formed in the same direction as one another. Relative to the axis 42 of the cylinder, the sloping surfaces 40*a*', 41*a*, and the sloping surfaces 40*b*', 41*b*' each have an angle $\alpha''=45°$.

FIG. 4*a* shows the position of the carding element 17 with the supporting body 23 and the clothings 20*a*', 20*b*, (shown in FIG. 2, 2*a*) as well as the cylinder 4 at a relatively low temperature $T_1$. The length of the supporting body 23 is indicated by reference letter $I_1$, the spacing between the plates 40*a* and 40*b* and the mounting plates 41*a* and 41*b*, respectively, by reference letter $h_1$ and the carding nip between the clothings 20*a*', 20*b*' and the cylinder clothing 4*a* (see FIG. 2) by reference letter a.

When, in operation, especially at a high production rate and/or when synthetic fibres or cotton/synthetic fibre mixtures are being processed, the carding work gives rise to heat in the carding nip a between the clothings 20*a*', 20*b*, and the cylinder clothing 4*a*, the shell of the cylinder expands, that is to say the radius $r_2$ (see FIG. 2) increases and the carding nip a decreases in size. The heat is conveyed by way of the cylinder shell into the radial supporting elements, the cylinder bases. The cylinder bases likewise expand as a result, that is to say the radius increases. The cylinder 4 is totally encased (surrounded by a housing) on virtually all sides: in the radial direction by elements 13, 17', and 17" (see FIG. 1) and to both sides of the carding machine by elements 19*a*, 19*b*. As a result, scarcely any heat from the cylinder 4 is emitted to the outside (to the atmosphere). The cylinder shell and the cylinder bases are made of steel, for example St 37, having a longitudinal thermal expansion coefficient of $11.5*10^{-6}$[1/(°k)]. In addition, the Al supporting body 23 likewise expands in the radial direction, which results in further narrowing of the carding nip a. Now the supporting body 23 is made of aluminium having a longitudinal thermal expansion coefficient of $23.8*10^{-6}$[1/(°k)]. By virtue of that high longitudinal thermal expansion coefficient, the supporting body 23 undergoes considerable expansion in the direction of arrow P, that is to say in the longitudinal direction.

FIG. 4*b* shows the position of the carding element 17 with the supporting body 23 as well as of the cylinder 4 at a relatively high temperature $T_2$. The length of the supporting body 23 has increased to the value $I_2$. As a result of the longitudinal thermal expansion of the supporting body 23 in the direction of arrows O and P, on both sides, by means of the adjusting screw 47, the adjusting elements 40*a* and 40*b* have been moved actively with their sloping surfaces 40*a*', 40*b*' on the sloping surfaces 41*a*' and 41*b*' of the adjusting elements 41*a*, 41*b*, respectively, outwards (arrows O, P) and upwards (arrow D). The spacing $h_1$, (FIG. 4*a*) has increased to the spacing $h_2$ (FIG. 4*b*). The displacement of the carding element 17 in the direction of arrow D is effected against the force of the springs 31*a* and 31*b*. In this way, the expansions of the cylinder 4 and of the supporting body 23 are so compensated in the radial direction that the carding nip a remains the same.

Figure 4C:
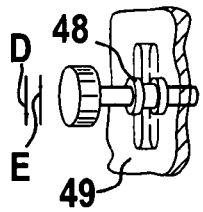
FIG. 4*c* is a perspective view of the adjusting screw and its bearing.

According to FIG. 4*c*, the adjusting screw 47 passes through an oblong hole 48 in a holding element 49 which is mounted on the mounting plate 27*a*.

Figure 5:
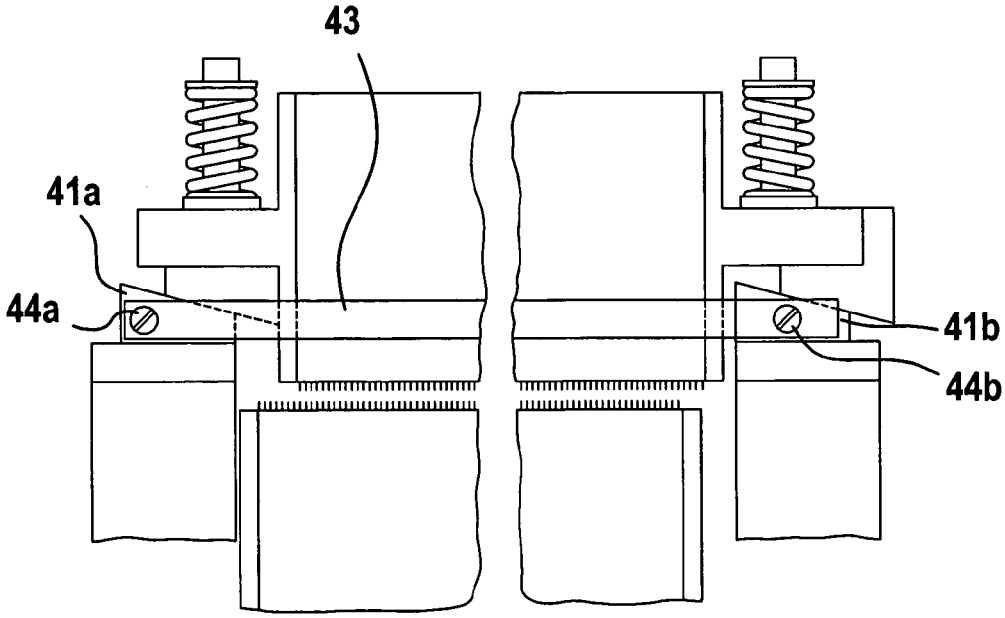
FIG. 5 shows the stationary wedge-shaped adjusting elements with a connecting element.

As shown in FIG. 5, the stationary adjusting elements 41*a*, 41*b* can be joined to one another by a connecting element 43 which consists of a material that exhibits low or no longitudinal expansion, for example CFP (carbon-fibre reinforced plastic) or Invarstahl. The connecting element 43 is attached to the adjusting elements 41*a*, 41*b* by means of fixing elements, for example screws 44*a*, 44*b*, respectively. If the side panels, curved extension pieces and/or bearings 19*a*, 19*b* become heated, the connecting element prevents the adjusting elements 41*a*, 41*b* from being displaced outwards with the undesirable result that the stationary sloping counter-surfaces of the adjusting elements 41*a*, 41*b* for the displaceable sloping counter-surfaces of the adjusting elements 40*a*, 40*b* are likewise displaced.

Figure 6:
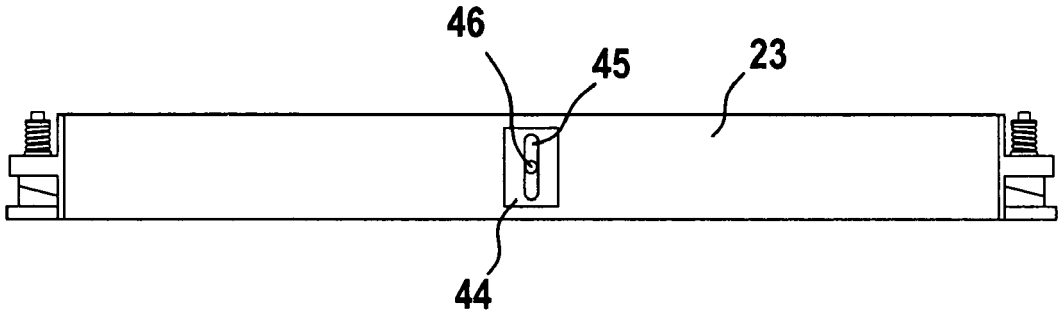
FIG. 6 shows a guide element associated with the centre of the supporting body.

In the embodiment of FIG. 6, in the longitudinal centre between the two end faces of the supporting body 23 there is mounted in fixed position a guide element 44 which has an oblong hole 45 extending in the radial direction relative to the cylinder 4 i.e. in a direction perpendicular to the longitudinal axis of the supporting body 23, through which hole 45 a lug 46 or the like mounted on the supporting body 23 projects. The lug 46 has, for example, a round, square or rectangular cross-section. If the supporting body 23 becomes heated and lengthened, the lug 46 is displaced in the fixed oblong hole 45 likewise in the direction D, but not in directions O or P. In that way, by means of the adjustment screw 47 uniform active displacement of the adjusting elements 40*a* and 40*b* by the same amount outwards in the same direction O or P is achieved.

Although the foregoing invention has been described in detail by way of illustration and example for purposes of understanding, it will be obvious that changes and modifications may be practised within the scope of the appended claims.

What is claimed is:

1. An adjustable machine element assembly for a spinning preparation machine, comprising:

a machine element arranged, in use, to lie opposed to and spaced from a roller of the spinning preparation machine and having a working portion and opposed first and second end portions, there being provided a first machine element bearing surface on said first end portion and a second machine element bearing surface on said second end portion; and first and second machine bearing surfaces associated with the spinning preparation machine; wherein said first machine element bearing surface and said first machine bearing surface co-operate to form a first adjusting structure and said second machine element bearing surface and said second machine bearing surface co-operate to form a second adjusting structure, said machine element bearing surfaces and said machine bearing surfaces each being inclined and a direction of inclination of the inclined surfaces being substantially the same in each of said first and second adjusting structures, whereby on thermally induced expansion of the machine element in a longitudinal direction relative displacement along the inclined surfaces can take place in such a manner that a spacing of the machine element from the roller can be maintained substantially unchanged.

2. An assembly according to claim 1, further comprising an actuating device for adjusting the spacing between the working portion of the machine element and the roller, the actuating device being arranged for effecting relative displacement along said inclined surfaces.

3. An assembly according to claim 1, in which an angle of inclination of the inclined surfaces is substantially the same.

4. An assembly according to claim 1, in which bearing points are in a form of an inclined plane, so that in an event of a change in length of the working element its height relative to the roller is adjustable.

5. An assembly according to claim 1, in which an angle of inclination is about from 35° to 55°.

6. An assembly according to claim 1, in which the working element has a first bearing member including said first machine element bearing surface and a second bearing member including said second machine element bearing surface.

7. An assembly according to claim 6, in which the bearing members are a separate component of the machine element.

8. An assembly according to claim 6, in which the bearing members are an integral part of the machine element.

9. An assembly according to claim 1, in which the end portions of the machine elements have inclined surfaces which provide said machine element bearing surfaces.

10. An assembly according to claim 1, in which the machine comprises first and second machine bearings, the first machine bearing being provided with a first machine bearing member including said first machine bearing surface, and the second machine bearing being provided with a second machine bearing member including said second machine bearing surface.

11. An assembly according to claim 10, in which the machine bearing members are attached to the bearings.

12. An assembly according to claim 10, in which the machine bearing members are an integral part of the machine bearings.

13. An assembly according to claim 1, in which the machine comprises first and second machine bearings and the machine bearing surfaces are surfaces thereof.

14. An assembly according to claim 1, in which the machine bearings are the curved extension pieces or the side panels of a carding machine.

15. An assembly according to claim 1, in which, in a region of each of the end portions and the associated machine bearings, there are present as bearing members two co-operating wedge-shaped elements.

16. An assembly according to claim 1, in which the machine element comprises a supporting body made of aluminium.

17. An assembly according to claim 1, in which for fixing a spacing of left-hand and right-hand bearing points there is a connecting bridge element which has a low thermal expansion coefficient.

18. An assembly according to claim 17, in which, for centering the machine element between the bearing points, there are provided resilient elements at the ends.

19. An assembly according to claim 17, in which the centering of the machine element is effected by a central fixing with the connecting bridge.

20. An assembly according to claim 1, comprising an adjusting drive means for active adjustment of the spacing between the cylinder and the carding element, the inclined planes formed in the same direction at opposed ends of the machine element serving to permit change of the spacing of the working element with respect to the roller.

21. An assembly according to claim 20, in which the adjusting drive means is an adjusting screw.

22. An assembly according to claim 20, in which the adjusting drive means is an adjusting motor.

23. An assembly according to claim 20, in which, for determining a desired active displacement, measurements of temperatures and/or pressures are used.

24. An assembly according to claim 1, in which the machine element is a fixed carding element, a take-off blade, or a cover element.

25. A carding machine comprising an assembly according to claim 1.

26. An apparatus on a spinning preparation machine, comprising:

at least one clothed and/or non-clothed, basically stationary machine element that lies opposite and spaced apart from a clothing of a roller, wherein bearing surfaces of end portions of the machine element are in engagement with respective bearing surfaces of stationary bearings; and an adjustment means arranged in a region of each of the end portions and the bearings, wherein the adjustment means is able to alter a radial spacing between the clothing of the roller and the machine element, wherein adjusting elements of the machine element and adjusting elements of the bearings each have sloping surfaces, angles of the sloping surfaces on both sides are formed in a same direction as one another, and wherein the machine element, in the event of undergoing thermally induced expansion in its longitudinal direction, is so displaceable along the sloping surfaces by means of the adjustment means so that the radial spacing remains the same.

* * * * *